US005530340A

United States Patent [19]

Hayakawa et al.

[11] Patent Number: 5,530,340

[45] Date of Patent: Jun. 25, 1996

[54] CONSTANT VOLTAGE GENERATING CIRCUIT

[75] Inventors: Yasushi Hayakawa; Masahiro Ueda, both of Itami, Japan

[73] Assignee: Mitsubishi Denki Kabushiki Kaisha, Tokyo, Japan

[21] Appl. No.: 357,408

[22] Filed: Dec. 16, 1994

[30] Foreign Application Priority Data

Mar. 16, 1994 [JP] Japan ..... 6-045761

[51] Int. Cl.$^6$ ..... G05F 3/16

[52] U.S. Cl. ..... 323/314; 323/315

[58] Field of Search ..... 323/313, 314, 323/315, 316, 317

[56] References Cited

U.S. PATENT DOCUMENTS 4,918,336 4/1990 Graham et al. ..... 326/117
5,304,918 4/1994 Khieu ..... 323/315
5,307,007 4/1994 Wu et al. ..... 323/313

FOREIGN PATENT DOCUMENTS 58-29616 6/1983 Japan .

*Primary Examiner*—Peter S. Wong
*Assistant Examiner*—Shawn Riley
*Attorney, Agent, or Firm*—Oblon, Spivak, McClelland, Maier & Neustadt

[57] ABSTRACT

A clamping circuit ($Q_3$) provides the second potential ($V_{EE}$) with a clamp voltage which remains a constant value even if the second potential ($V_{EE}$) varies, to obtain a clamp potential ($V_c$). A little variation of the clamp voltage due to the variation of the second potential ($V_{EE}$) is transferred to a current generating circuit ($Q_4$) and then a feedback current ($I_3$) is applied to a feedback circuit ($Q_2$) in response to the variation of the clamp voltage. Since an output potential ($V_O$) outputted from an output circuit ($Q_1$) varies in response to the variation of the second potential ($V_{EE}$), an output voltage which is a potential difference between the output potential ($V_O$) and the second potential ($V_{EE}$) remains at a constant value.

14 Claims, 11 Drawing Sheets

104

CONSTANT VOLTAGE GENERATING CIRCUIT

BACKGROUND OF THE INVENTION

1. Field of the Invention

The present invention relates in general to a stabilization technique in a constant voltage generating circuit. More particularly, the present invention relates to a technique for receiving the first and second potentials to output an output voltage, and lessening a dependency upon a variation of the second potential.

2. Description of the Background Art

FIG. 10 is a circuit diagram showing a configuration a bias circuit 100 which is an example of a background art constant voltage generating circuit. In the figure, transistors $T_1$ and $T_2$ are NPN-type BJTs (Bipolar Junction Transistors). The collector of the transistor $T_1$ is connected through a resistor $R_2$ (hereinafter, the resistance of the resistor $R_2$ is also represented as $R_2$, and the same rule applies correspondingly to the following) to the first power supply line $V_{CC}$ (hereinafter, the potential to be provided as the first potential by the first power supply line $V_{CC}$ is also represented as $V_{CC}$). The emitter of the transistor $T_1$ is connected through a resistor $R_1$ to the second power supply line $V_{EE}$ (hereinafter, the potential to be provided as the second potential by the second power supply line $V_{EE}$ is also represented as $V_{EE}$). For example, the first potential $V_{CC}$ is set to 0V and the second potential $V_{EE}$ is set to negative potential of ECL level.

On the other hand, in the transistor $T_2$, the collector is connected directly to the first power supply line $V_{CC}$, the emitter is connected through a resistor $R_3$ to the second power supply line $V_{EE}$ and the base is connected the collector of the transistor $T_1$. The base of the transistor $T_1$ and an output terminal are connected to the emitter of the transistor $T_2$.

The output terminal receives an output potential $V_O$ to output the potential difference between the output potential $V_O$ and the second potential $V_{EE}$ as an output potential $V_{CS}$.

The operation of the bias circuit 100 having the aforementioned configuration will be described. The collector of the transistor $T_1$, the resistor $R_2$ and the base of the transistor $T_2$ are connected at a node A and the emitter of the transistor $T_1$ and the resistor $R_1$ are connected at a node B. Representing the potential of the node B as $V_B$, the following relation is satisfied:

$$V_O = V_B + V_1 \tag{1}$$

Assuming now that the base-emitter voltages of the transistors $T_1$ and $T_2$ are $V_1$ and $V_2$, respectively, in disregard of the base currents of the transistors $T_1$ and $T_2$, Formula (1) is transformed into the following expression:

$$\begin{aligned} V_O &= \frac{R_1}{R_1+R_2}\cdot(V_{CC}-V_{EE}-V_1-V_2)+V_{EE}+V_1 \\ &= \frac{1}{R_1+R_2}\{R_1V_{CC}+R_2V_{EE}+(R_2V_1-R_1V_2)\} \end{aligned} \tag{2}$$

Preferably, the output voltage, $V_{CS}=V_O-V_{EE}$, is always constant. Taking a case where the bias circuit 100 is connected to an ECL circuit by way of example, the reason will be described below.

FIG. 11 is a circuit diagram showing a configuration of the ECL circuit $Q_9$ connected to the bias circuit 100 and connection of these two circuits. This figure shows the employment of an inverter as the ECL circuit $Q_9$. The ECL circuit $Q_9$ comprises a transistor $T_{11}$ the base of which receives an input signal, a transistor $T_{12}$ a base of which receives a fixed potential $V_{BB}$ and a current source $Q_{10}$ connected common to the emitters of the transistors $T_{11}$ and $T_{12}$, drawing a current out of these transistors into the power supply line $V_{EE}$. The collectors of the transistors $T_{11}$ and $T_{12}$ are connected through respective resistors to the first power supply line $V_{CC}$.

The current source $Q_{10}$ comprises a transistor $T_{10}$ a collector of which is connected in common to the emitters of the transistors $T_{11}$ and $T_{12}$ and a base of which receives the output potential $V_O$ of the bias circuit 100 and a resistor $R_{10}$ connecting the emitter of the transistor $T_{10}$ with the second power supply line $V_{EE}$.

When the output potential $V_{CS}$ varies, the current from the current source $Q_{10}$ accordingly varies, so that it cannot remain constant. That causes malfunction of the ECL circuit $Q_9$. Therefore, in order to stabilize the operation of ECL circuit $Q_9$ which is connected to the bias circuit 100, it is desirable to keep the output voltage, $V_{CS}=V_O-V_{EE}$, always at a constant value.

On the other hand, the variation of the output voltage $V_{CS}$ is caused by the variations of the first and second potentials $V_{CC}$ and $V_{EE}$. Let us consider now a case where the first potential $V_{CC}$ is fixed to 0V without variation and the second potential $V_{EE}$ having negative value may vary.

The dependency of the output voltage $V_{CS}$ upon the second potential $V_{EE}$ can be obtained from Formula (2) as follows:

$$\begin{aligned} \frac{\partial V_{CS}}{\partial V_{EE}} &= \frac{\partial}{\partial V_{EE}}(V_O-V_{EE}) \\ &= \frac{R_1}{R_1+R_2}\frac{\partial V_{CC}}{\partial V_{EE}}+\frac{R_1}{R_1+R_2}+\frac{1}{R_1+R_2}\left(R_2\frac{\partial V_1}{\partial V_{EE}}-R_1\frac{\partial V_2}{\partial V_{EE}}\right)-1 \\ &= \frac{R_1}{R_1+R_2}\frac{\partial V_{CC}}{\partial V_{EE}}+\frac{1}{R_1+R_2}\left(R_2\frac{\partial V_1}{\partial V_{EE}}-R_1\frac{\partial V_2}{\partial V_{EE}}\right)-\frac{R_1}{R_1+R_2} \end{aligned} \tag{3}$$

Since the first potential $V_{CC}$ is fixed to 0 V without variation, the following formula is obtained:

$$\frac{\partial V_{CS}}{\partial V_{EE}} = \frac{1}{R_1+R_2}\left(R_2\frac{\partial V_1}{\partial V_{EE}}-R_1\frac{\partial V_2}{\partial V_{EE}}\right)-\frac{R_1}{R_1+R_2} \tag{4}$$

In this formula, the first term on the right-hand side represents the dependency of the base-emitter voltages $V_1$ and $V_2$ of the transistors $T_1$ and $T_2$ upon the second potential $V_{EE}$ which is approximately negligible in comparison with the second term.

On the other hand, since $R_2/R_1$ is usually determined to around 1 in order to make the temperature dependency of the output voltage $V_{CS}$ low, even if the first term on the right-hand side is negligible, the dependency of the output voltage $V_{CS}$ upon the second potential $V_{EE}$ is expressed as follows:

$$\frac{\partial V_{CS}}{\partial V_{EE}} \approx -\frac{R_1}{R_1+R_2} \approx -\frac{1}{2} \quad (5)$$

$$\left(\text{where } \frac{\partial V_1}{\partial V_{EE}} \approx 0, \frac{\partial V_2}{\partial V_{EE}} \approx 0\right)$$

Since the background art bias circuit 100 has the aforementioned configuration, when the second potential $V_{EE}$ which is lower than the first potential varies, the output voltage $V_{CS}$ also varies in proportion to the variation of the second potential $V_{EE}$. For this reason, there arises a problem of causing malfunction of the ECL circuit $Q_9$ connected to the bias circuit 100.

SUMMARY OF THE INVENTION

The present invention is directed to a constant voltage generating circuit. According to the first aspect of the present invention, the constant voltage generating circuit comprises: (a) a first potential point and a second potential point for providing a first potential and a second potential which are different from each other; (b) an output circuit having (b-1) an output terminal; (b-2) an output resistor including a first end connected to the output terminal and a second end connected to the second potential point; (b-3) an output transistor including a first current electrode connected to the first potential point, a second current electrode connected to the output terminal and a control electrode; (c) a clamping circuit having (c-i) a clamp output terminal for applying a clamp voltage which is almost constant with variation of predetermined range to the second potential to output a clamp potential; (c-2) a variation output terminal for transferring the variation of the clamp voltage; (d) a feedback circuit having (d-1) a first feedback input terminal connected to the output terminal; (d-2) a second feedback input terminal connected to the clamp output terminal; (d-3) a third feedback input terminal; (d-4) a feedback output terminal for providing the control electrode of the output transistor with a potential which is negatively fed back in response to potential variations of the first to third feedback input terminals; and (e) a current generating circuit having (e-1) a variation input terminal connected to the variation output terminal, the current generating circuit supplying the third feedback input terminal with a feedback current which increases or decreases in response to a potential difference between a potential of the variation input terminal and the second potential.

In the constant voltage generating circuit in accordance with the first aspect of the present invention, the potential to be applied to the output terminal, the clamp potential and the feedback current in response to the variation of the clamp potential are fed back to the feedback circuit and then the feedback circuit applies a negative feedback to the output circuit.

Thus, since the negative feedback is applied as a function of not only the potential of the output terminal but also the clamp potential, stabilization of the potential difference between the potential of the output terminal and the second potential is accomplished. Moreover, since the negative feedback is also applied as a function of the variation of the clamp voltage, the potential variation at the output terminal due to the variation of the clamp voltage within a predetermined range is lessened, thereby ensuring further stabilization of the above potential difference.

According to the second aspect of the present invention, the feedback circuit further has (d-5) a first resistor connected between the first potential point and the second feedback input terminal; (d-6) a second resistor connected between the second feedback input terminal and the feedback output terminal; (d-7) a feedback transistor including a first current electrode connected to the feedback output terminal and the third feedback input terminal, a control electrode connected to the first feedback input terminal and a second current electrode; and (d-8) a third resistor connected between the second current electrode of the feedback transistor and the second potential point.

In the constant voltage generating circuit in accordance with the second aspect of the present invention, the first resistor retains the potential difference between the first potential and the clamp potential. Therefore, the clamp potential varies in response to the variation of the second potential, not depending upon the first potential.

According to the third aspect of the present invention, the feedback output terminal and the third feedback input terminal are connected direct to each other in the feedback circuit.

In the constant voltage generating circuit in accordance with the third aspect of the present invention, the voltage drop caused only by the feedback current and the second resistor varies the potential of the control electrode of the output transistor.

Thus, since only the second resistor serves to vary the potential of the control electrode of the output transistor, simplification of the configuration is achieved.

According to the fourth aspect of the present invention, the clamping circuit further has (c-3) a clamp potential generating transistor including a first current electrode connected to the first potential point, a control electrode connected to the clamp output terminal and a second current electrode; and (c-4) a clamp potential variation detecting transistor including a first current electrode connected to the second current electrode of the clamp potential generating transistor, a second current electrode connected to the second potential point and a control electrode connected to the variation output terminal.

In the constant voltage generating circuit in accordance with the fourth aspect of the present invention, the voltage between the control electrode and the second current electrode of the clamp potential generating transistor is provided as part of the clamp potential. The clamp potential variation detecting transistor detects the variation of the clamp voltage to be transferred to the variation output terminal.

Thus, the feedback current responsive to the variation of the clamp voltage can be obtained in the current generating circuit.

According to the fifth aspect of the present invention, the control electrode and the first current electrode are connected direct to each other in the clamp potential variation detecting transistor.

In the constant voltage generating circuit in accordance with the fifth aspect of the present invention, the voltage between the control electrode and the second current electrode of the clamp potential variation detecting transistor is provided as part of the clamp voltage.

Thus, not only the voltage between the control electrode and the second current electrode of the clamp potential generating transistor but also the voltage between the control electrode and the second electrode of the clamp potential variation detecting transistor are provided as part of the clamp voltage, thereby ensuring a higher clamp voltage.

In the case where the clamp circuit consists of the clamp potential generating transistor and the clamp potential variation detecting transistor which are connected in series with each other, especially, there is a voltage retained between the control electrode and the second current electrode of the output transistor in the output circuit, and therefore, when the subsequent stage has only one circuit to be connected to the output terminal, an improvement in temperature characteristic of the current flowing in the subsequent stage transistor is achieved.

According to the sixth aspect of the present invention, the clamping circuit further has (c-5) a diode disposed in series between the second current electrode of the clamp potential generating transistor and the first current electrode of the clamp potential variation detecting transistor.

In the constant voltage generating circuit in accordance with the sixth aspect of the present invention, the diode provides part of the clamp voltage.

Thus, in addition to the voltages between the control electrode and the second current electrode of the clamp potential generating transistor and between the control electrode and the second current electrode of the clamp potential variation detecting transistor, the diode also provides part of the clamp voltage, so that much higher clamp voltage can be obtained.

According to the seventh aspect of the present invention, the clamping circuit further has (c-6) a resistor disposed in series between the second current electrode of the clamp potential generating transistor and the first current electrode of the clamp potential variation detecting transistor.

In the constant voltage generating circuit in accordance with the seventh aspect of the present invention, the resistor controls the current flowing in the first current electrode of the clamp potential variation detecting transistor.

Thus, by controlling the current flowing in the first current electrode of the clamp potential variation detecting transistor, the variation of the variation output terminal in response to the variation of the second potential can be controlled.

According to the eighth aspect of the present invention, the current generating circuit further has (e-2) a current generating transistor including a first current electrode in which the feedback current flows, a control electrode connected to the variation input terminal and a second current electrode connected to the second potential point.

In the constant voltage generating circuit in accordance with the eighth aspect of the present invention, the current generating transistor converts the variation of the clamp voltage into the feedback current.

Thus, the feedback current is controlled so as to respond to the variation of the clamp voltage, so that the voltage drop across the second resistor can be controlled to lessen the dependency of the potential variation of the feedback output terminal upon the clamp voltage.

According to the ninth aspect of the present invention, the current generating circuit further has (e-3) a first resistor disposed in series between the second current electrode of the current generating transistor and the second potential point.

In the constant voltage generating circuit in accordance with the ninth aspect of the present invention, the first resistor controls the dependency of the feedback current upon the variation of the clamp voltage.

Thus, since the dependency of the feedback current upon the variation of the clamp voltage is controlled, the voltage drop across the second resistor is controlled more effectively.

According to the tenth aspect of the present invention, the constant voltage generating circuit comprises: (a) a first potential point and a second potential point for providing a first potential and a second potential which are different from each other; (b) an output circuit having (b-1) an output terminal; (b-2) an output resistor including a first end connected to the output terminal and a second end connected to the second potential point; (b-3) an output transistor including a first current electrode connected to the first potential point, a second current electrode connected to the output terminal and a control electrode; (c) a current mirror circuit having (c-1) an input and an output end; (c-2) a first branch including a first end connected to the input end and a second end connected to the second potential point; (c-3) a second branch including a first end connected to the output end and a second end connected to the second potential point, the current mirror circuit supplying the second branch with a current in proportion to a current flowing in the first branch; (d) a clamping circuit connected to the input end of the current mirror circuit, for applying a clamp voltage which is almost constant with variation of predetermined range to the second potential to output a clamp potential; (e) a feedback circuit having (e-1) a first feedback input terminal connected to the output terminal; (e-2) a second feedback input terminal for receiving the clamp potential; (e-3) a third feedback input terminal connected to the output end of the current mirror circuit; and (e-4) a feedback output terminal for providing the control electrode of the output transistor with a potential which is negatively fed back in response to potential variations of the first to third feedback input terminals.

In the constant voltage generating circuit in accordance with the tenth aspect of the present invention, the clamping circuit provides part of the clamp voltage and the current mirror circuit applies the feedback current in proportion to the current flowing in the clamping circuit to the feedback circuit.

Since the variation of the clamp voltage is reflected on the feedback current, the potential variation at the feedback output terminal of the feedback circuit due to the variation of the clamp voltage is lessened.

According to the eleventh aspect of the present invention, the clamping circuit has (d-1) a clamp potential generating transistor including a first current electrode connected to the first potential point, a second current electrode connected to the input end of the current mirror circuit and a control electrode to be provided with the clamp potential.

In the constant voltage generating circuit in accordance with the eleventh aspect of the present invention, the first branch of the current mirror circuit provides part of the clamp voltage.

Thus, in addition to the voltage between the control electrode and the second current electrode of the clamp potential generating transistor, the first branch of the current mirror circuit also provides part of the clamp voltage, so that higher clamp voltage can be obtained.

According to the twelfth aspect of the present invention, the clamping circuit further has (d-2) a diode disposed in series between the second current electrode of the clamp potential generating transistor and the input end of the current mirror circuit.

In the constant voltage generating circuit in accordance with the twelfth aspect of the present invention, the diode also provides part of the clamp voltage. Therefore, higher clamp voltage can be obtained.

Thus, in the constant voltage generating circuit according to the present invention, the feedback circuit is provided with the clamp potential obtained by applying the almost constant clamp voltage to the second potential, so that the output potential can keep at a constant value with no influence of the variation of the second potential. Moreover, since the feedback current compensates for the variation of the clamp voltage, the dependency of the output voltage upon the second potential is eliminated to thereby ensure a stabilized output voltage.

An object of the present invention is to provide a stabilized constant voltage generating circuit by lessening the dependency of an output voltage upon the second potential having relatively low value.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
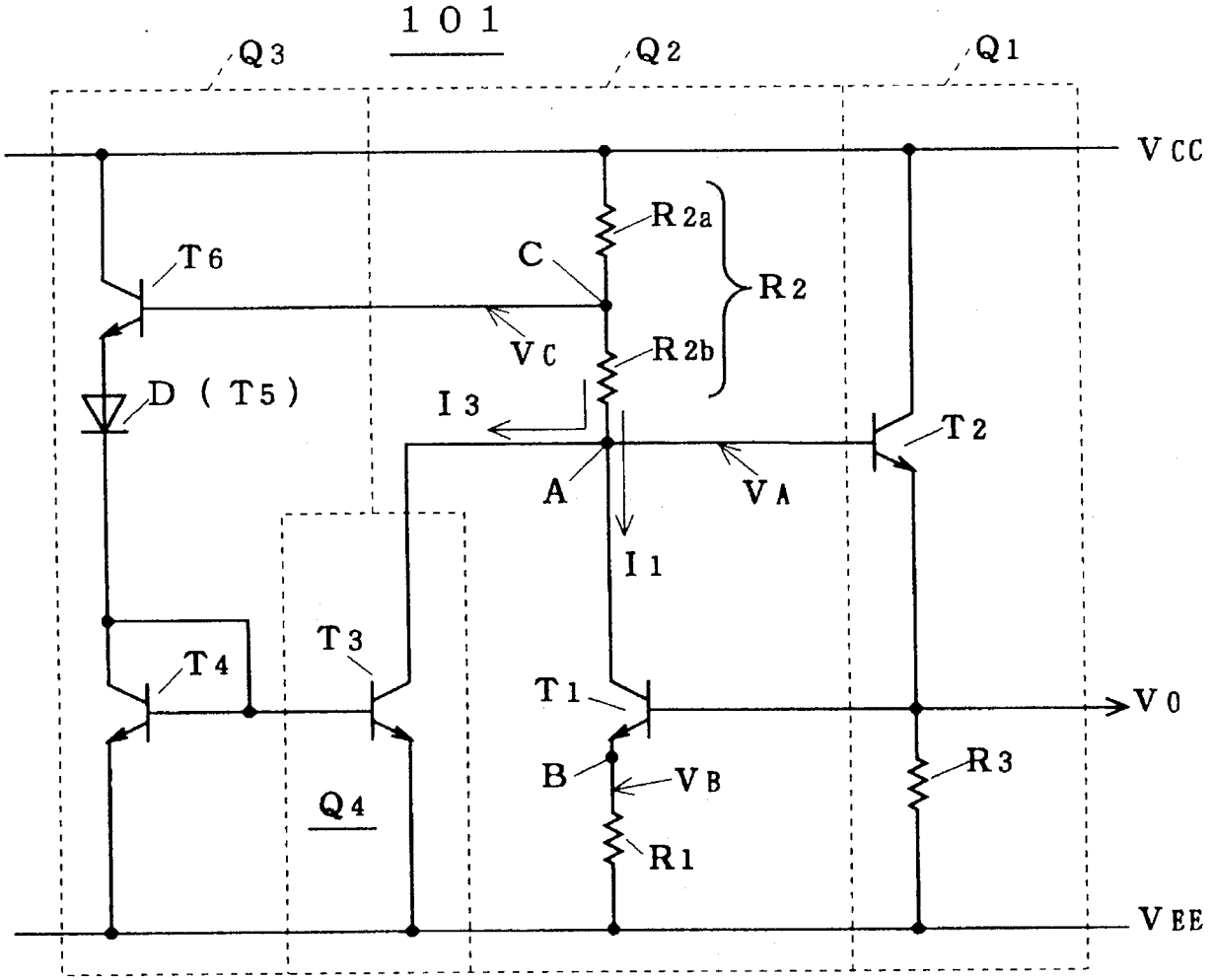
FIG. 1 is a circuit diagram showing a configuration in accordance with a first preferred embodiment of the present invention.

A. The First Preferred Embodiment:

(A-1) Configuration:

FIG. 1 is a circuit diagram showing a configuration of a bias circuit 101 in accordance with the first preferred embodiment of the present invention.

The bias circuit 101 comprises four circuits, i.e., an output circuit $Q_1$, a feedback circuit $Q_2$, a clamping circuit $Q_3$ and a current generating circuit $Q_4$.

Figure 11:
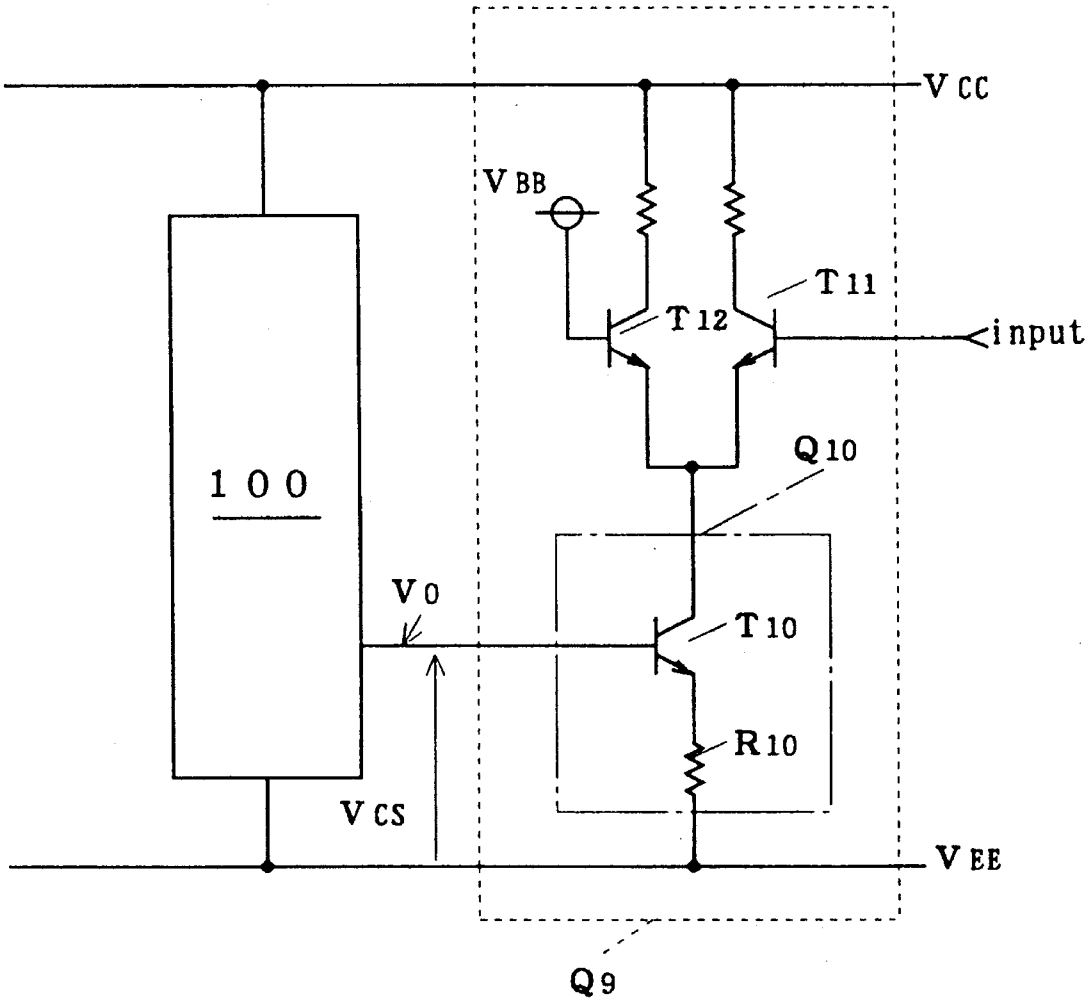
FIG. 11 PRIOR ART
FIG. 11 is a circuit diagram of the conventional art.

The output circuit $Q_1$ and the feedback circuit $Q_2$ constitutes the bias circuit 100 as shown in FIG. 11. Specifically, the collector of the transistor $T_1$ , the base of the transistor $T_2$ and one end of the resistor $R_2$ are connected at a node A. The other end of the resistor $R_2$ is connected to the first power supply line $_{CC}$. Furthermore, the resistor $R_2$ is divided at a node C into two resistors $R_{2a}$ and $R_{2b}$ which are connected in series to each other.

The emitter of the transistor $T_2$ is connected to the base of the transistor $T_1$ and one end of the resistor $R_3$. The end of the resistor $R_3$ is also connected to the output terminal and is provided with the output potential $V_O$. The other end of the resistor $R_3$ is connected to the second power supply line $V_{EE}$.

The emitter of the transistor $T_1$ is connected to one end of the resistor $R_1$ at a node B, and the other end of the resistor $R_1$ is connected to the second power supply line $V_{EE}$.

The clamping circuit $Q_3$ comprises a transistor $T_4$ including an emitter connected to the second power supply line $V_{EE}$, a collector and a base which are connected common to each other, a diode D including a cathode connected to the collector of the transistor $T_4$ and a transistor $T_6$ including a collector connected to the first power supply line $V_{CC}$, a base connected to the feedback circuit $Q_2$ at the node C and an emitter connected to an anode of the diode D.

Figure 2:
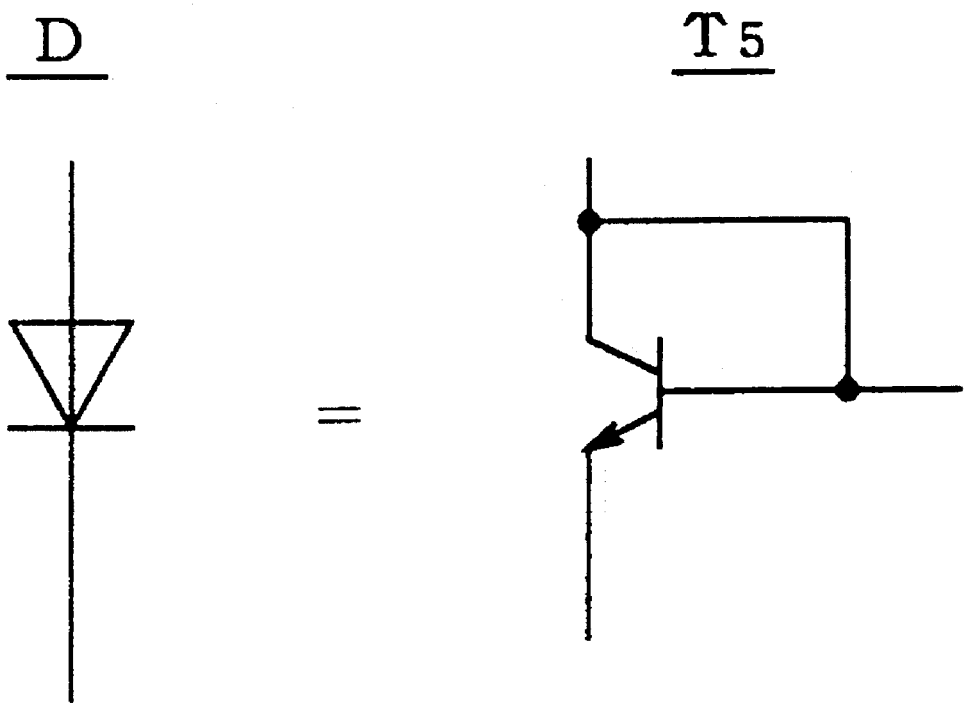
FIG. 2 is a circuit diagram showing a configuration of a diode D utilizing a transistor $T_5$.

As shown in FIG. 2, the diode D may be provided by employing a transistor $T_5$ of which collector and base are connected direct to each other. In this case, the cathode and anode of the diode D correspond to the emitter and the collector, respectively, of the transistor $T_5$.

The current generating circuit $Q_4$ comprises a transistor $T_3$ including an emitter connected to the second power supply line $V_{EE}$, a base connected common to the base and collector of the transistor $T_4$ and a collector connected to the feedback circuit $Q_2$ at the node A.

In the aforementioned circuits, the transistors $T_3$ to $T_6$ are NPN-type BJTs (Bipolar Junction Transistors) like the transistors $T_1$ and $T_2$.

(A-2) Qualitative Description of Operation:

In the bias circuit 101 having the aforementioned configuration, the feedback circuit $Q_2$ receives three feedback inputs and applies negative feedback to the output circuit $Q_1$.

The first feedback input is the output potential $V_O$. In other words, the base of the transistor $T_1$ serves as the first feedback input terminal. The first feedback input has been also used in the background art bias circuit 100. The variation of the potential difference between the output potential $V_O$ and the second potential $V_{EE}$ allows the bias of the transistor $T_1$ to change, to thereby cause a variation of the currents in the resistors $R_1$ and $R_2$. As the result, a potential $V_A$ at the node A also varies to apply negative feedback to the bias of the base potential of the transistor $T_2$, thereby reducing the variation of the potential difference between the output potential $V_O$ and the second potential $V_{EE}$. The node A serves as an feedback output terminal.

The second feedback input is a potential $V_C$ at the node C. The node C serves as the second feedback input terminal. The clamping circuit $Q_3$ applies a clamp potential which is higher by a predetermined clamp voltage to the node C even if the second potential $V_{EE}$ varies. The clamp voltage is the sum of base-emitter voltages $V_4$, $V_5$ and $V_6$ of the transistors $T_4$, $T_5$ and $T_6$.

Accordingly, in disregard of the dependency of the clamp voltage upon the second potential $V_{EE}$ (in other words, the dependency of the base-emitter voltages $V_4$, $V_5$ and $V_6$ upon the second potential $V_{EE}$), the potential difference between the potential $V_C$ and the second potential $V_{EE}$ is maintained within a specified range. In this case, a voltage is developed across the resistor $R_{2a}$, thereby retaining the potential difference between the clamp potential (potential $V_C$) and the first potential $V_{CC}$. Therefore, the potential $V_C$ varies in response to the variation of the second potential $V_{EE}$ although the first potential $V_{CC}$ is fixed.

On the other hand, the resistance $R_{2b}$ retains the potential difference between the potentials $V_C$ and $V_A$. In disregard of the base current of the transistor $T_2$, a current $I_1$ from the transistor $T_1$ and a current 13 from the transistor $T_3$ of the current generating circuit $Q_4$, reflecting the dependency of the clamp voltage upon the second potential $V_{EE}$, flow in the resistor $R_{2b}$.

Therefore, in disregard of the dependency of the clamp voltage upon the second potential $V_{EE}$, the current $I_1$ always takes the value depending only on the clamp voltage. Accordingly, the potential $V_A$ at the node A varies in response to the variation of the second potential $V_{EE}$ and negative feedback is applied to the base of the transistor $T_2$ to supply a bias to the potential thereof. Applying such a negative feedback means cancelling the second term of the right-hand side of Formula (4).

The third feedback input is the current $I_3$. When the dependency of the clamp voltage upon the second potential $V_{EE}$, i.e., the dependency of the base-emitter voltages $V_4$, $V_5$ and $V_6$ upon the second potential $V_{EE}$ is not ignored, the clamping circuit $Q_3$ alone can not keep the clamp voltage at an exactly constant value. For this reason, the variation of base-emitter voltage $V_4$ of the transistor $T_4$ is transferred to the transistor $T_3$ Of the current generating circuit $Q_4$ and then the current having the value corresponding to the variation is applied to the resistor $R_{2b}$.

Thus, in the first preferred embodiment, the node A serves not only as the third feedback input terminal for receiving the third feedback input but also as the feedback output terminal for applying the feedback output to the base potential of the transistor $T_2$.

For example, when the second potential $V_{EE}$ drops (i.e., its absolute value becomes higher), the base-emitter voltages $V_4$, $V_5$ and $V_6$ rise, that is, the clamp voltage rises. In this case, a base-emitter voltage $V_3$ of the transistor $T_3$ rises and the current 13 increases. Accordingly, the voltage drop across the resistor $R_{2b}$ increases and thereby the potential $V_A$ drops, so that the potential difference between the potential $V_A$ and the second potential $V_{EE}$ decreases. As the result, even if the clamp voltage increases, the node A serving as the feedback output terminal can properly apply the potential $V_A$ as feedback output to the output circuit $Q_1$ . Even if the second potential $V_{EE}$ rises, the node A can also properly apply the potential $V_A$ to the output circuit $Q_1$. Applying such a negative feedback means cancelling the first term of the right-hand side of Formula (4).

Thus, the first preferred embodiment of the present invention provides a stabilized output voltage by employing two more feedback inputs as compared with the background art bias circuit 100. The clamping circuit $Q_3$ and the current generating circuit $Q_4$ are arranged so that the two additional feedback inputs can be obtained.

Considering that the feedback inputs can be obtained as above, the transistor $T_4$ not only provides part of the clamp voltage but also detect the variation thereof. The transistors $T_5$ and $T_6$ provide part of the clamp voltage in the clamping circuit $Q_3$.

The current generating circuit $Q_4$ receives the variation of the clamp voltage to generate a feedback current which varies in response to the variation.

(A-3) Quantitative description:

The operation of the bias circuit 101 will be quantitatively described below by using formulae.

The potentials $V_A$ and $V_C$ at the nodes A and C, output potential $V_O$ and the current $I_1$ are expressed as follows:

$$V_A=V_C-(I_1+I_3)\cdot R_{2b} \tag{6}$$

$$V_C=V_4+V_5+V_6+V_{EE} \tag{7}$$

$$V_O=V_A-V_2 \tag{8}$$

$$I_1=(V_B-V_{EE})/R_1=(V_O-V_1V_{EE})/R_1 \tag{9}$$

where the first potential $V_{CC}$ is fixed to 0V. Substituting Formula (6) into Formula (8), the following formula can be obtained:

$$V_O=V_C-V_2-(I_1+I_3)\cdot R_{2b} \tag{10}$$

Substituting Formulae (7) and (9) into Formula (10), the following formula can be obtained:

$$V_O=V_4+V_5+V_6+V_{EE} -V_2-[(V_O-V_1-V_{EE})/R_1+I_3]\cdot R_{2b} \tag{11}$$

Therefore, the output voltage $V_{CS}$ is expressed as follows:

$$V_{CS}=\frac{R_1}{R_1+R_{2b}}\left[V_1\cdot\frac{R_{2b}}{R_1}-V_2+V_4+V_5+V_6-I_3\cdot R_{2b}\right] \tag{12}$$

Accordingly, the dependency upon the second potential $V_{EE}$ is expressed as follows:

$$\frac{\partial V_{CS}}{\partial V_{EE}}=\frac{1}{R_1+R_{2b}}\left(R_{2b}\frac{\partial V_1}{\partial V_{EE}}-R_1\frac{\partial V_2}{\partial V_{EE}}\right)+\frac{R_1}{R_1+R_{2b}}\cdot\frac{\partial}{\partial V_{EE}}(V_4+V_5+V_6-I_3\cdot R_{2b}) \tag{13}$$

The first and second terms of the right-hand side of Formula (13) correspond to the first and second terms of the right-hand side of Formula (4), respectively. If the dependencies of the base-emitter voltages of respective transistors upon the second potential $V_{EE}$ are negligible, the first term of the right-hand side of Formula (13) is negligible like in the background art. Furthermore, in Formula (13), since the dependency of the current $I_3$ upon the second potential $V_{EE}$ is also negligible, the following relation is held:

$$\frac{\partial V_{CS}}{\partial V_{EE}}\approx 0 \tag{14}$$

$$\left(\text{where}\ \frac{\partial V_i}{\partial V_{EE}}\approx 0(i=1\sim 6)\right)$$

Therefore, the second term of the right-hand side of Formula (4) is also negligible, and accordingly, the output voltage $V_{CS}$ is constant even if the second potential $V_{EE}$ may vary.

The reason why the dependency of the current $I_3$ upon the second potential $V_{EE}$ is negligible will be described. In general, the base-emitter voltage $V_{EE}$ and the collector current $I_C$ (which may be equal to the emitter current if the base current is negligible) of a transistor have the following relation:

$$I_C \propto \exp\left(\frac{V_{BE}}{V_T}\right) \tag{15}$$

where the voltage $V_T$ takes a constant value, for example, about 26 mV in the case of a silicon transistor. From Formula (15), the dependency of the current $I_3$ upon the second potential $V_{EE}$ is expressed as follows:

$$\frac{\partial I_3}{\partial V_{EE}} = \frac{I_3}{V_T} \cdot \frac{\partial V_3}{\partial V_{EE}} \tag{16}$$

Therefore, if the dependency of the base-emitter voltage $V_3$ upon the second potential $V_{EE}$ is very small, the dependency of the current $I_3$ upon the second potential $V_{EE}$ is negligible like other transistors.

Moreover, in the bias circuit 101 in accordance with the first preferred embodiment, even if the dependency of the base-emitter voltage $V_i$ of each transistor $T_i$ (i=1 to 6) upon the second potential $V_{EE}$ is not negligible, the operation dependency thereof upon the second potential $V_{EE}$can be lessened unlike the background art bias circuit 100.

Formula (13) will be transformed by utilizing Formula (6) into the following formula:

$$\frac{\partial V_{CS}}{\partial V_{EE}} = \frac{R_{2b}}{R_1 + R_{2b}} \left[ \left( \frac{\partial V_1}{\partial V_{EE}} - \frac{R_1 \cdot I_3}{V_T} \cdot \frac{\partial V_3}{\partial V_{EE}} \right) + \left( \frac{R_1}{R_{2b}} \right) \cdot \frac{\partial}{\partial V_{EE}} (V_4 + V_5 + V_6 - V_2) \right] \tag{17}$$

Since the dependencies of the transistors $V_i$ (i=1 to 6) upon the second potential $V_{EE}$ are almost equal, if the resistance $R_1$ is set to so much smaller value than the resistance $R_{2b}$, for example less than 1/10, Formula (17) can be approximately expressed as follows:

$$\frac{\partial V_{CS}}{\partial V_{EE}} \approx \frac{\partial V_1}{\partial V_{EE}} - \frac{R_1 \cdot I_3}{V_T} \cdot \frac{\partial V_3}{\partial V_{EE}} \quad (\text{where } R_1 << R_{2b}) \tag{18}$$

On the other hand, as is clearly seen from FIG. 1, the collectors of the transistors $T_1$ and $T_3$ are connected common to each other. The emitter of the transistor $T_3$ is connected to the second power supply line $V_{EE}$ and the emitter of the transistor $T_1$ is connected through the resistor $R_1$ to the second power supply line $V_{EE}$. Setting the resistance $R_1$ too small will make the dependencies of the emitter-base voltages $V_i$ of the transistors $T_1$ and $T_3$ upon the second potential $V_{EE}$ almost equal even if the transistors $T_1$ and $T_3$ have the same size.

Therefore, the right-hand side of Formula (18) can be made almost zero by setting the feedback current $I_3$ as follows:

$$I_3 = V_T / R_1 \tag{19}$$

Setting the resistance $R_1$ to a proper value will achieve such a setting of the feedback current $I_3$ as above.

Thus, the first preferred embodiment can provide a more stabilized output voltage as compared with the conventional art when the dependencies of the base-emitter voltages $V_i$ upon the second potential are negligible, and moreover can also provide a stabilized output voltage through simple setting even if the dependencies are not negligible.

Figure 3:
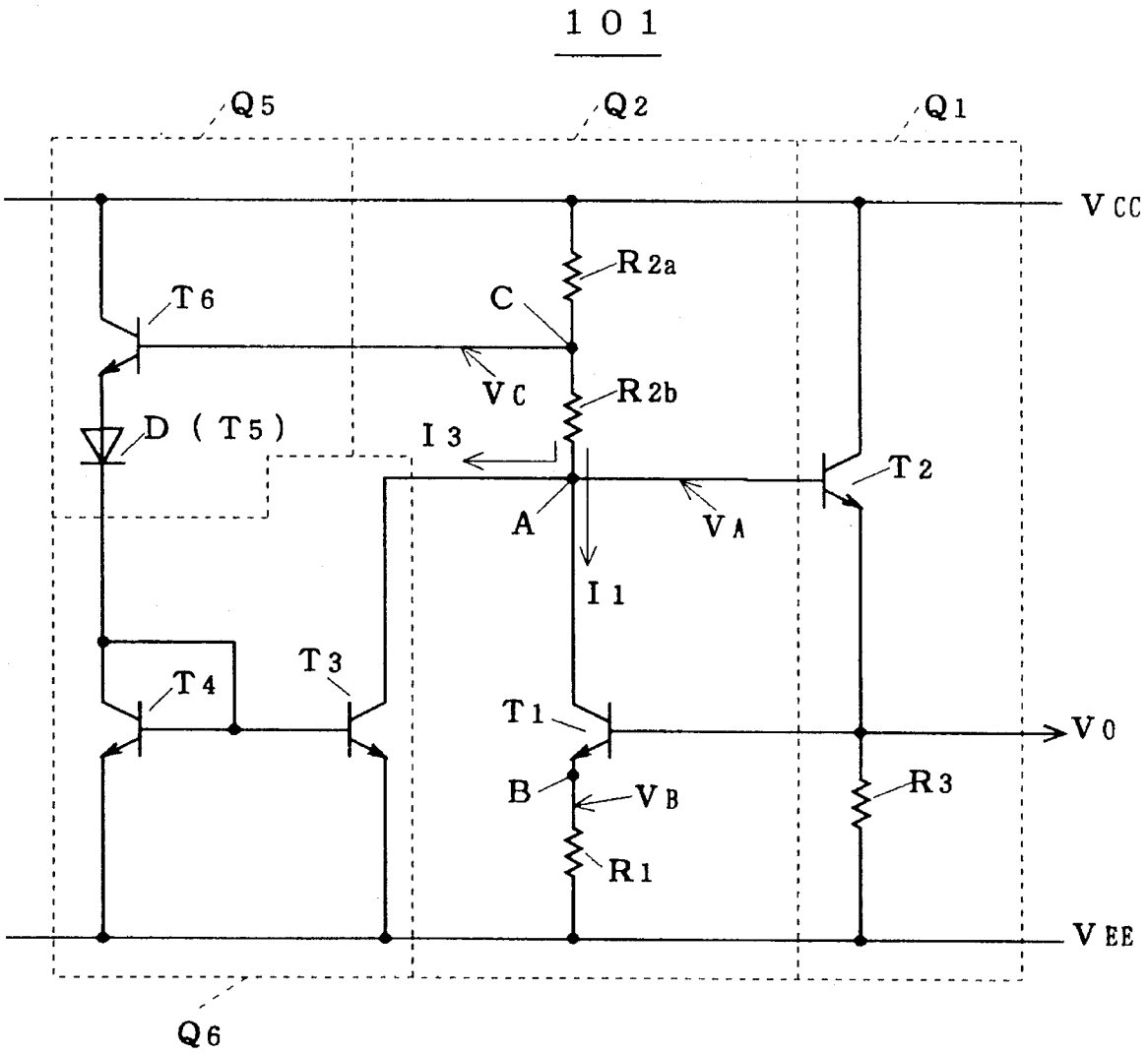
FIG. 3 is a circuit diagram showing a configuration in accordance with the first preferred embodiment of the present invention.

(A-4) Description from Another Standpoint:

The configuration of the bias circuit 101 will be described from another point of view. FIG. 3 is a circuit diagram showing a configuration of the bias circuit 101, in which the connection of elements is the same as shown in FIG. 1. Furthermore, in FIG. 3, the grouping blocks are different from those of FIG. 1.

FIG. 3 shows the output circuit $Q_1$ and the feedback circuit $Q_2$ like in FIG. 1 and a clamping circuit $Q_5$ and a current mirror circuit $Q_6$ instead of the clamping circuit $Q_3$ and the current generating circuit $Q_4$ Of FIG. 1.

The clamping circuit $Q_5$ comprises the transistors $T_5$ (D) and $T_6$ and provides part of the clamp voltage. The current mirror circuit $Q_6$ comprises the transistors $T_3$ and $T_4$, and the transistor $T_4$ provides part of the clamp voltage.

When the second potential $V_{EE}$ rises (i.e., its absolute value becomes lower), the base-emitter voltage $V_4$ of the transistor $T_4$ decreases. Accordingly, the collector current of the transistor $Q_4$ decreases. Since the transistors $T_3$ and $T_4$ constitute of the current mirror circuit $Q_6$, the current $I_3$ flowing in the transistor $T_3$ decreases as the collector current of the transistor $T_4$ decreases. Hence, the voltage drop across the resistor $R_{2b}$ decreases and the output potential $V_O$ rises. This compensates for a rise of the second potential $V_{EE}$ to keep the output voltage $V_{CS}$ at a constant value.

On the other hand, when the second potential $V_{EE}$ drops (i.e., its absolute value becomes higher), the base-emitter voltage $V_4$ of the transistor $T_4$ increases. Accordingly, the collector current of the transistor $Q_4$ increases and then the current $I_3$ flowing in the transistor $T_3$ increases. Hence, the voltage drop across the resistor $R_{2b}$ increases and the output potential $V_O$ drops. This compensates for a drop of the second potential $V_{EE}$ to keep the output voltage $V_{CS}$ at a constant value.

Figure 4:
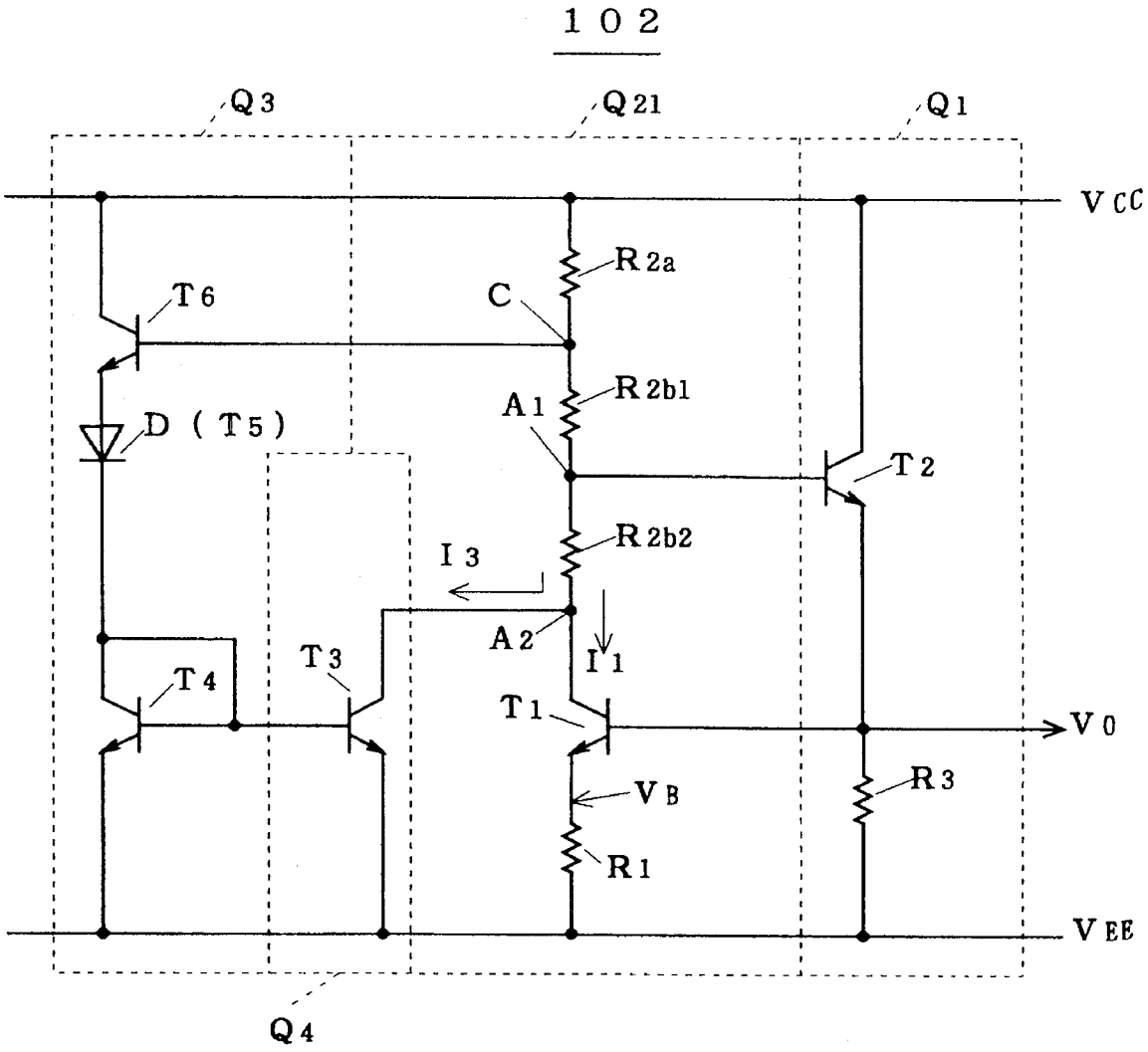
FIG. 4 is a circuit diagram showing a configuration in accordance with a second preferred embodiment of the present invention.

B. The Second Preferred Embodiment:

FIG. 4 is a circuit diagram showing a configuration of a bias circuit 102 in accordance with the second preferred embodiment of the present invention. The bias circuit 102 has a feedback circuit $Q_{21}$ instead of the feedback circuit $Q_2$ of the bias circuit 101.

In the feedback circuit $Q_{21}$, the resistor $R_{2b}$ of the feedback circuit $Q_2$ is divided into two resistors $R_{2b1}$ and $R_{2b2}$. The one end of the resistor $R_{2b1}$ is connected to the node C and the other end thereof is connected to the one end of the resistor $R_{2b2}$ and the base of the transistor $T_2$ at a node $A_1$. The other end of the resistor $R_{2b2}$ is connected common to the collectors of the transistors $T_1$ and $T_3$ at a node $A_2$.

Since the feedback circuit $Q_{21}$ has the aforementioned configuration, the feedback current $I_3$ serving as the third feedback input is applied to the node $A_2$. The node $A_2$ serves as the third feedback input terminal and the node A1 serves as the feedback output terminal to output the feedback output to the base of the transistor $T_2$.

In conformity with the second preferred embodiment, the first preferred embodiment corresponds to a case where $R_{2b2}$=0 and the nodes $A_1$ and $A_2$ are at one as the node A.

Thus, by separating the third feedback input terminal and the feedback output terminal and further providing the resistor $R_{2b2}$, the second preferred embodiment, having the effect of the first preferred embodiment, increases a designing flexibility and enables proper setting of the feedback output to be applied to the base of the transistor $T_2$.

Furthermore, the second preferred embodiment has an advantage of easy construction as compared with the third preferred embodiment.

Figure 5:
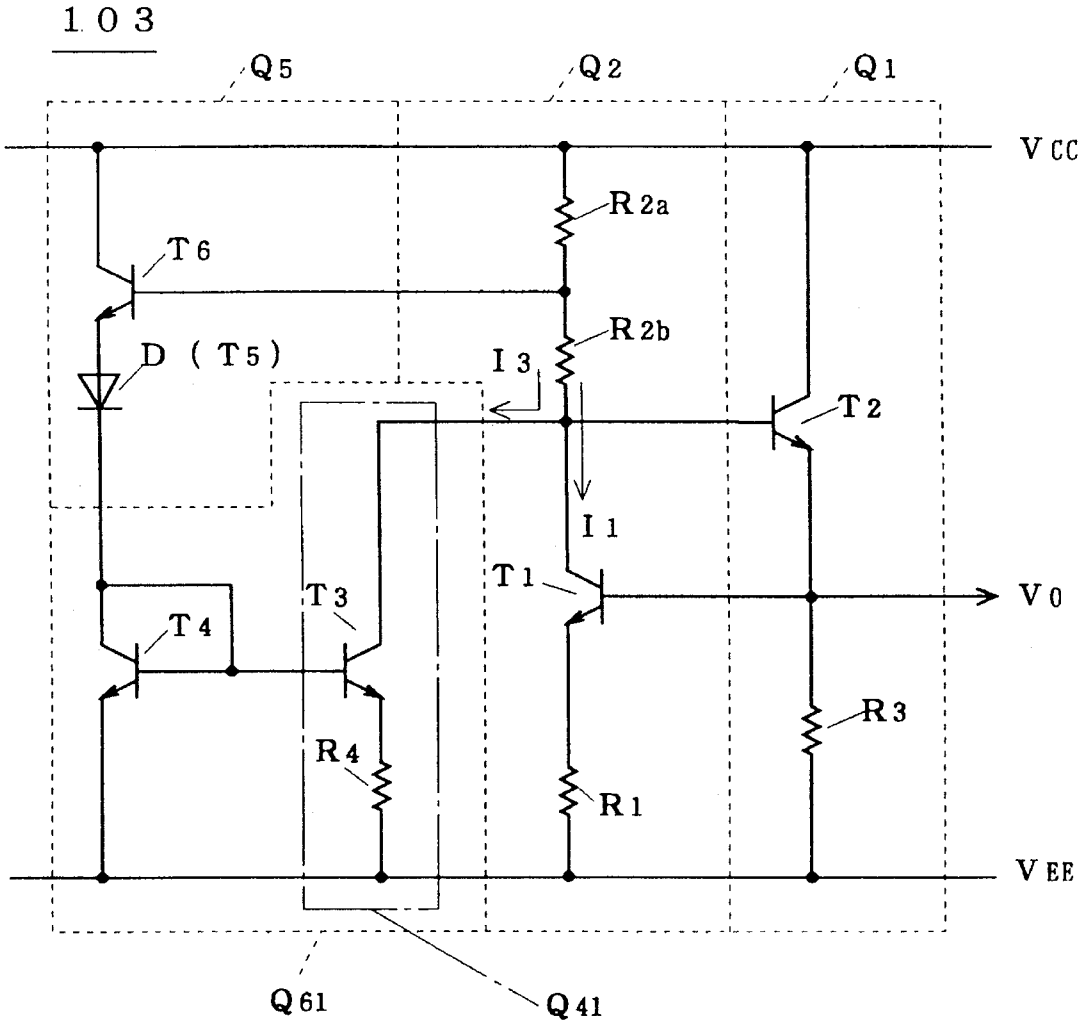
FIG. 5 is a circuit diagram showing a configuration in accordance with a third preferred embodiment of the present invention.

C. The Third Preferred Embodiment:

FIG. 5 is a circuit diagram showing a configuration of a bias circuit 103 in accordance with the third preferred embodiment of the present invention. The bias circuit 103 has a current mirror circuit $Q_{61}$ instead of the current mirror circuit $Q_6$ in the bias circuit 101 of FIG. 3 in accordance with the first preferred embodiment.

The current mirror circuit $Q_{61}$ further comprises a resistor $R_4$ between the transistor $T_3$ and the second power supply line $V_{EE}$ in the current mirror circuit $Q_6$ of FIG. 3. As well known with respect to the operation of current mirror circuit, a resistor which is connected to the emitter serves to change the ratio of the current flowing in the transistor $T_4$ and the current $I_3$ from the transistor $T_3$. Therefore, it becomes much easier to design a circuit to satisfy the relation as expressed in Formula (19).

It can be also seen from FIG. 5 that the bias circuit 103 has a current generating circuit $Q_{41}$ instead of the current generating circuit $Q_4$ in the bias circuit 101 of FIG. 1 in accordance with the first preferred embodiment.

Figure 6:
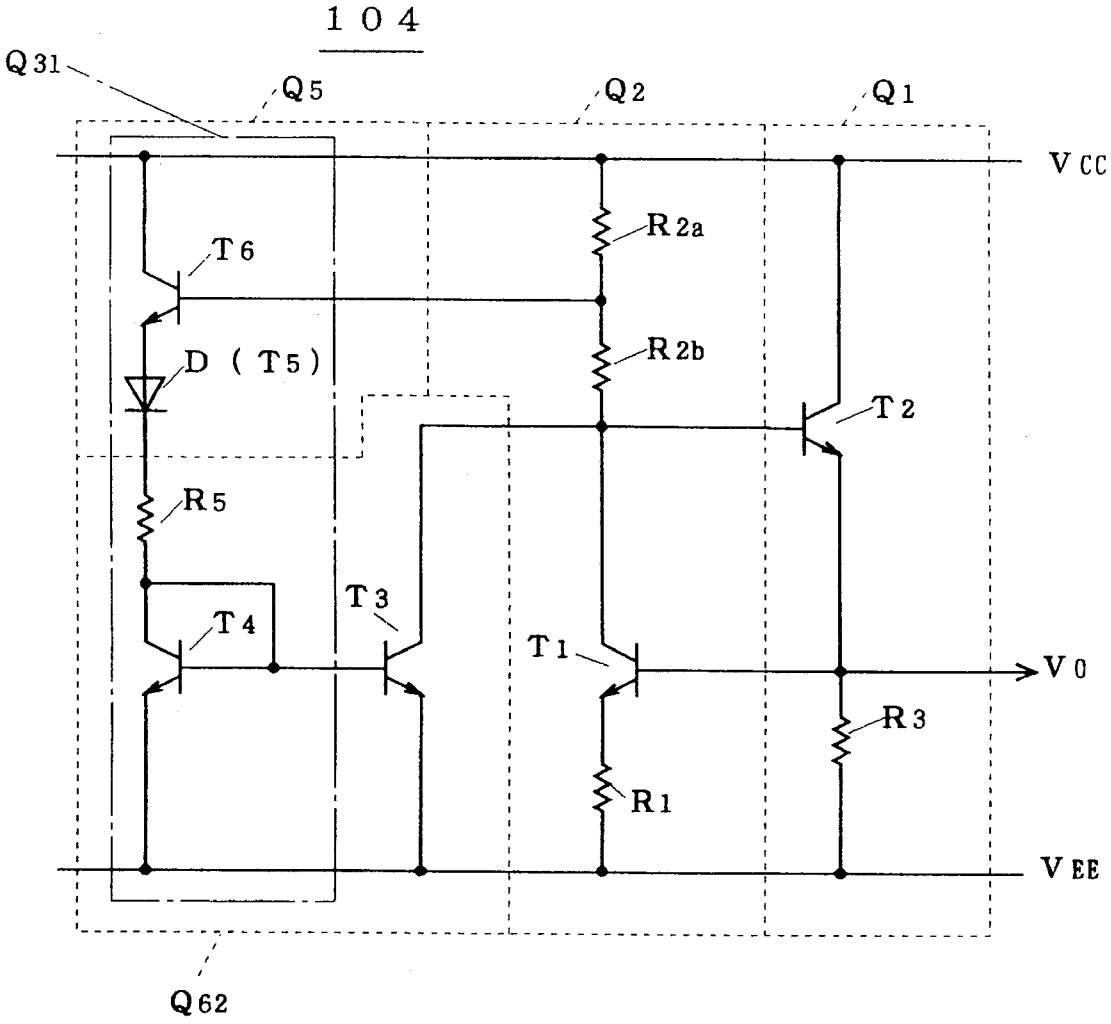
FIG. 6 is a circuit diagram showing a configuration in accordance with a fourth preferred embodiment of the present invention.

D. The Fourth Preferred Embodiment:

FIG. 6 is a circuit diagram showing a configuration of a bias circuit 104 in accordance with the fourth preferred embodiment of the present invention. The bias circuit 104 has a current mirror circuit $Q_{62}$ instead of the current mirror circuit $Q_6$ in the bias circuit 101 of FIG. 3 in accordance with the first preferred embodiment.

The current mirror circuit $Q_{62}$ further comprises a resistor $R_5$ between the collector of the transistor $T_4$ and the clamping circuit $Q_5$ in the current mirror circuit $Q_6$ Of FIG. 3. In the bias circuit 104, as compared with the bias circuit 101, the clamp voltage rises and moreover the current flowing in the transistor $T_4$ decreases by further providing the resistor $R_5$. Accordingly, the current $I_3$ from the transistor $T_3$ also decreases. Therefore, the fourth preferred embodiment increases the designing flexibility in designing a circuit to satisfy the relation as expressed in Formula (19) and achieves an easier designing.

It can be also seen from FIG. 6 that the bias circuit 104 has a clamping circuit $Q_{31}$ instead of the clamping circuit $Q_3$ in the bias circuit 101 of FIG. 1 in accordance with the first preferred embodiment.

Furthermore, the fourth preferred embodiment, as compared with the third preferred embodiment, has an advantage of easier optimization and a disadvantage of smaller variation of the current $I_3$ in response to the resistance variation. For this reason, it should be decided which to use, the third preferred embodiment or the fourth preferred embodiment, in consideration of a balance of cost depending on the designing time and the required performance.

Figure 7:
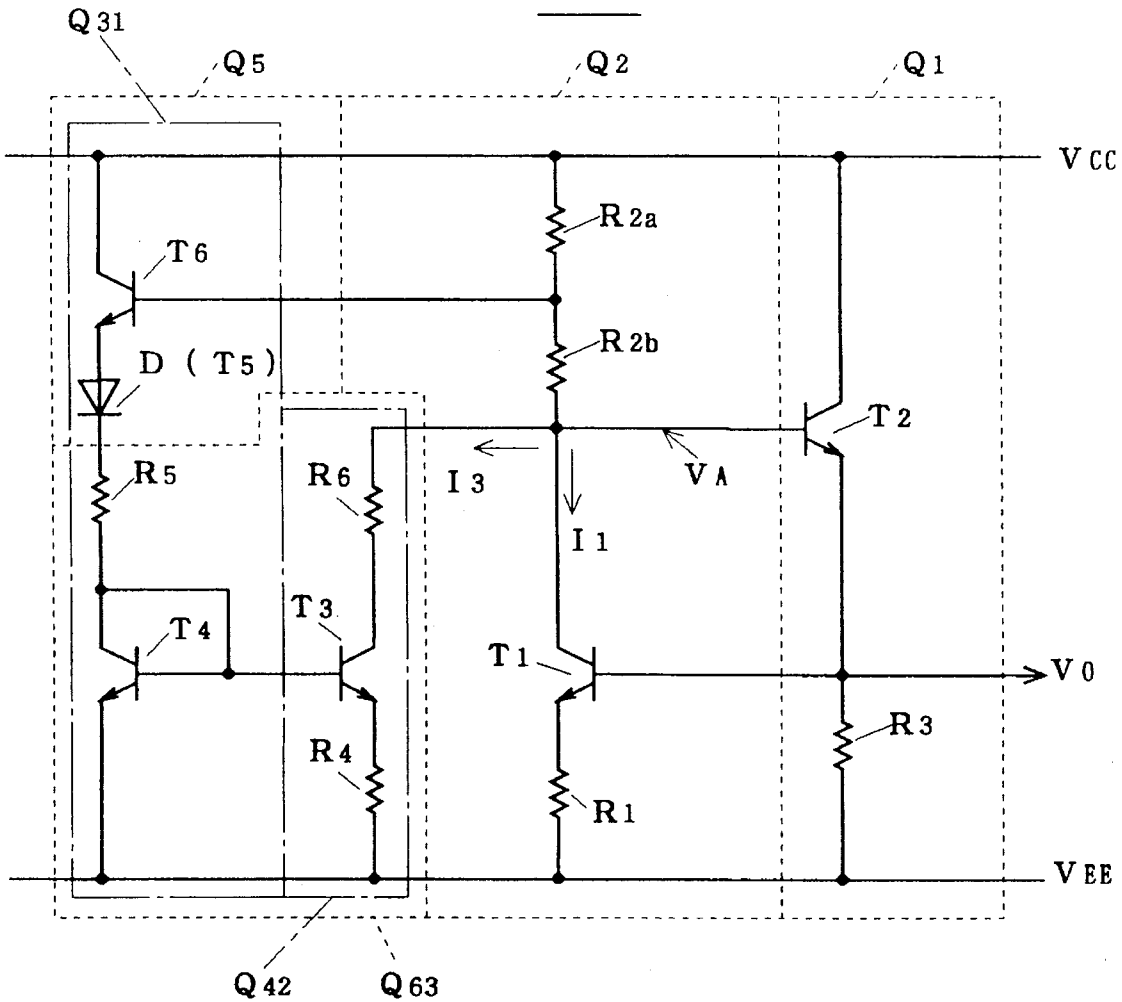
FIG. 7 is a circuit diagram showing a configuration in accordance with a fifth preferred embodiment of the present invention.

E. The Fifth Preferred Embodiment:

FIG. 7 is a circuit diagram showing a configuration of a bias circuit 105 in accordance with the fifth preferred embodiment of the present invention. The bias circuit 105 has a current mirror $Q_{63}$ instead of the current mirror circuit $Q_6$ in the bias circuit 101 of FIG. 3 in accordance with the first preferred embodiment. The current mirror circuit $Q_{63}$ comprises the resistor $R_4$ like the current mirror circuit $Q_{61}$ in the bias circuit 103 of FIG. 5 in accordance with the third preferred embodiment, a resistor $R_5$ like the current mirror circuit $Q_{62}$ in the bias circuit 104 of FIG. 6 in accordance with the fourth preferred embodiment and further comprises a resistor $R_6$ between the collector of the transistor $T_3$ and the feedback circuit $Q_2$.

In the fifth preferred embodiment, as compared with the third or fourth preferred embodiment, further provision of the resistor $R_6$ causes a decrease in the current $I_3$ . In other words, an increase of the number of the resistors further increases the designing flexibility.

It can be also seen from FIG. 7 that the bias circuit 105 has a clamping circuit $Q_{31}$ and a current generating circuit $Q_{42}$ instead of the clamping circuit $Q_3$ and the current generating circuit $Q_4$, respectively, in the bias circuit 101 of FIG. 1 in accordance with the first preferred embodiment.

Figure 8:
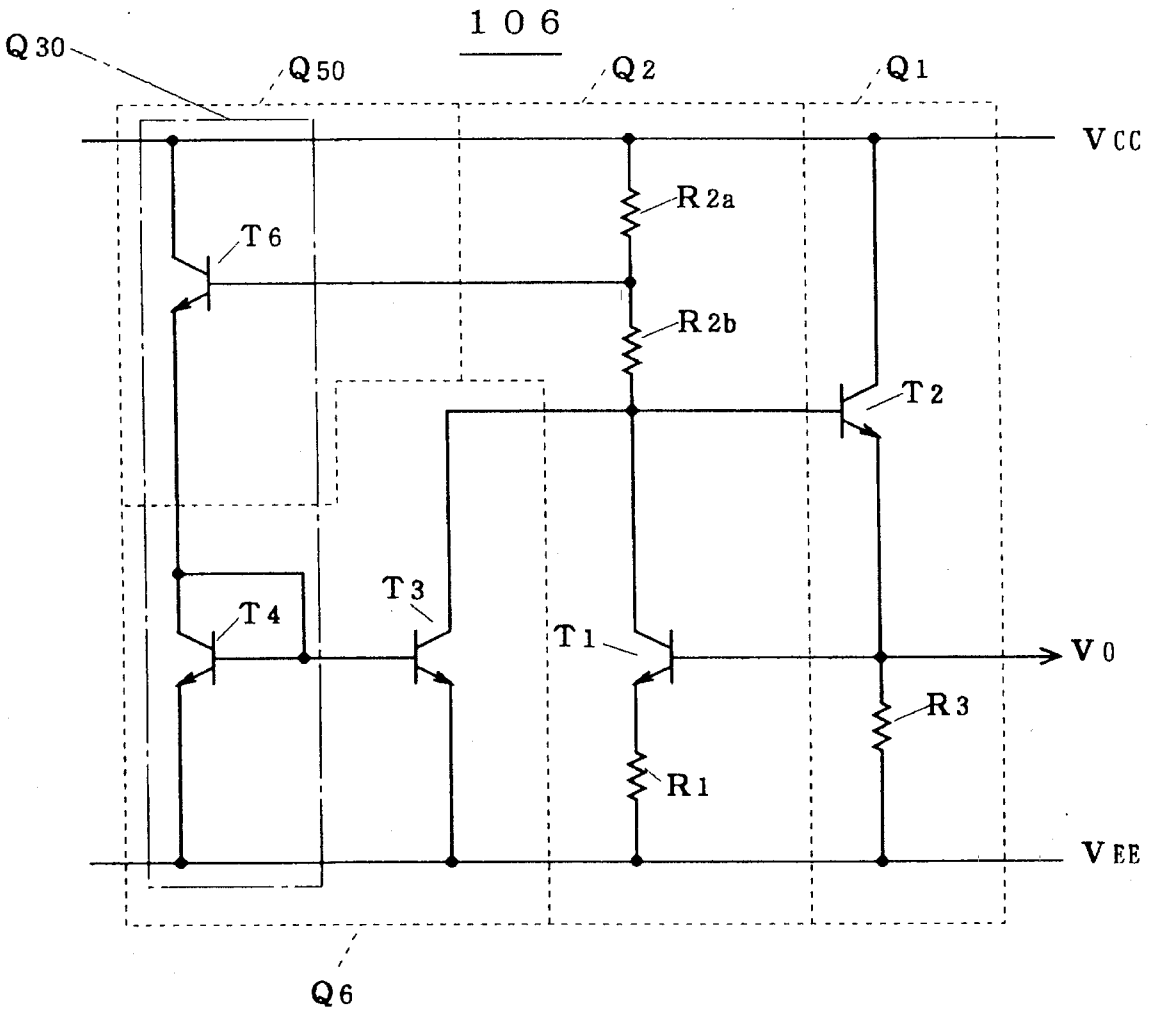
FIG. 8 is a circuit diagram showing a configuration in accordance with a sixth preferred embodiment of the present invention.

F. The Sixth Preferred Embodiment:

FIG. 8 is a circuit diagram showing a configuration of a bias circuit 106 of the sixth preferred embodiment of the present invention. The bias circuit 106 has a clamping circuit $Q_{30}$ instead of the clamping circuit $Q_3$ in the bias circuit 101 of FIG. 1.

In the clamping circuit $Q_{30}$, the diode D (transistor $T_5$) is omitted from the clamping circuit $Q_3$. The collector of the transistor $T_4$ and the emitter of the transistor $T_6$ are connected direct to each other. In conformity with the first preferred embodiment, this configuration corresponds to a case where the base-emitter voltage $V_5$ is zero. However, the effect of the first preferred embodiment can be also achieved because Formula (18) is deduced from Formula (17).

Figure 9:
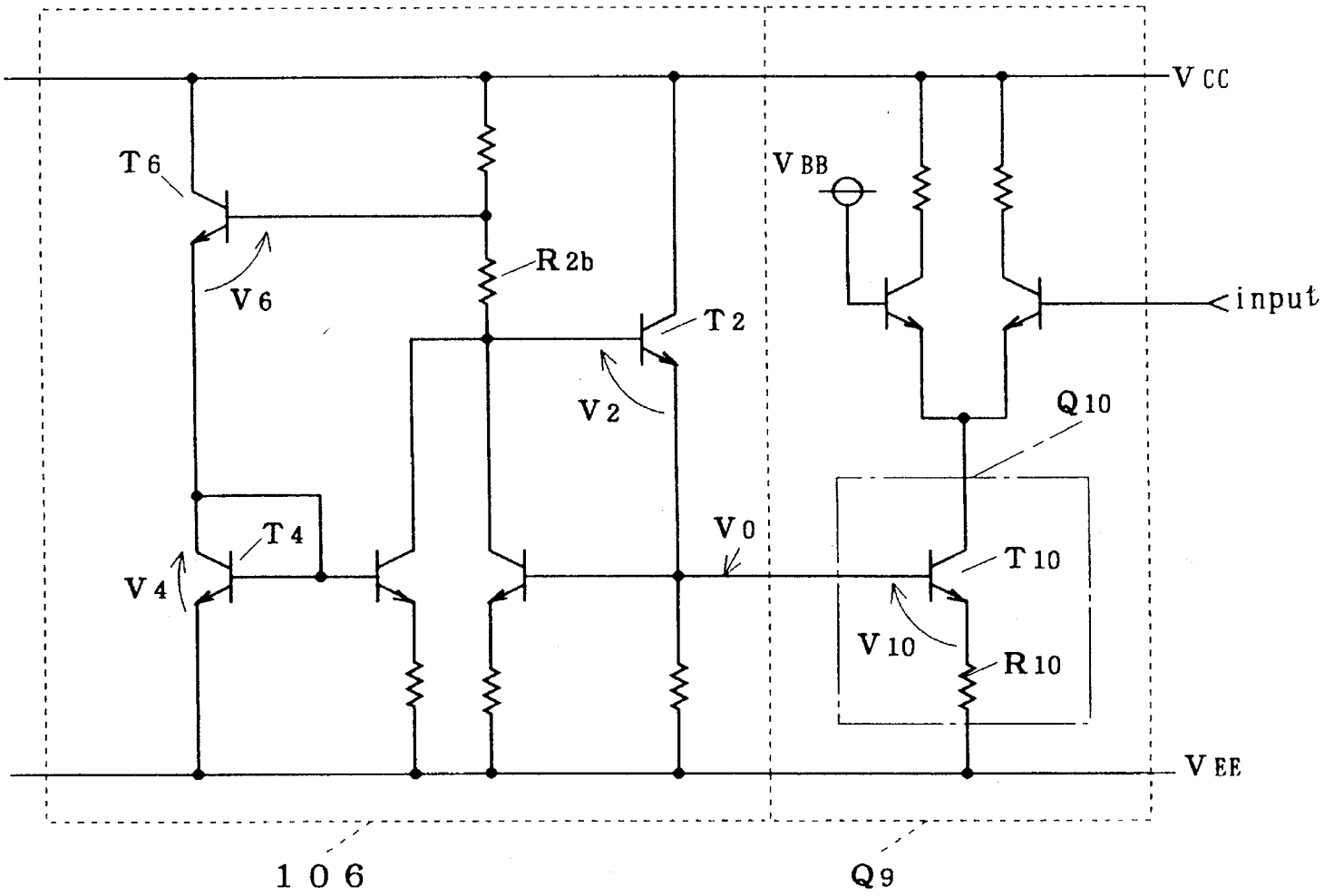
FIG. 9 is a circuit diagram showing an operation in accordance with a sixth preferred embodiment of the present invention.
Figure 10:
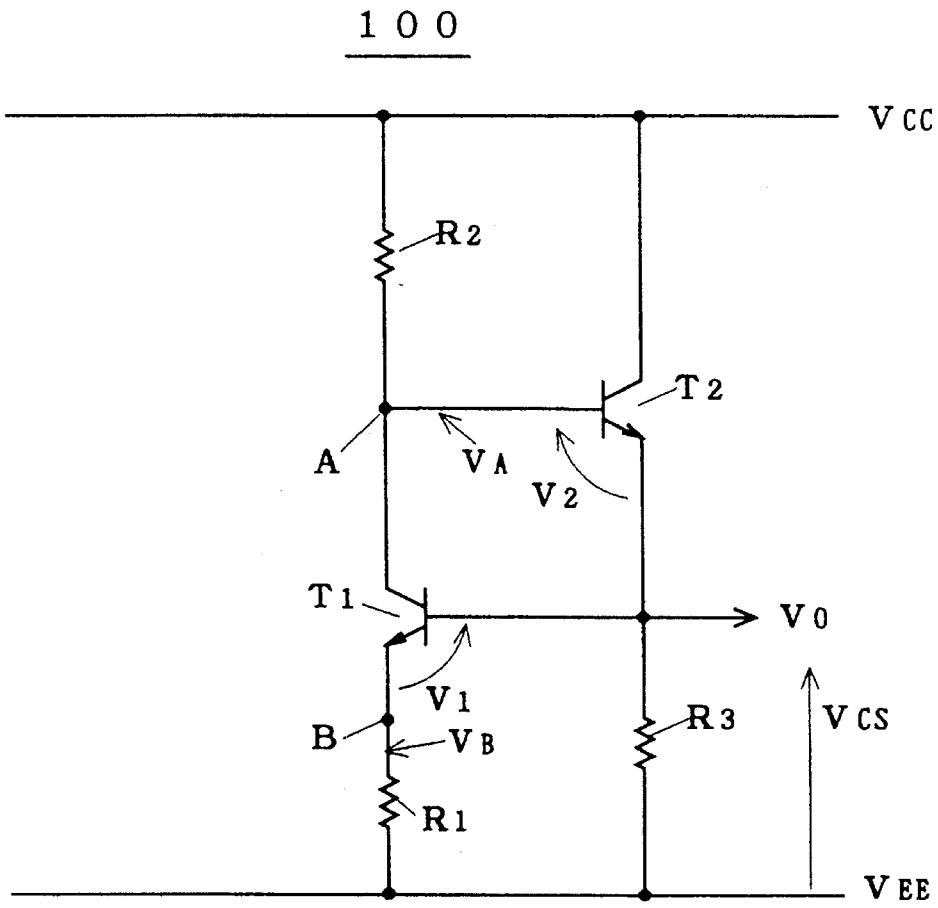
FIG. 10 PRIOR ART
FIG. 10 is a circuit diagram of a conventional art.

FIG. 9 is a circuit diagram showing the connection of the bias circuit 106 and an ECL circuit $Q_9$, corresponding to FIG. 12. As shown in FIG. 9, when the current source $Q_{10}$ in the ECL circuit $Q_9$ has only one transistor $T_{10}$, a temperature dependency of the current therefrom depends on a temperature dependency of the base-emitter voltage $V_{10}$ of the transistor $T_{10}$.

On the other hand, a temperature dependency of the output voltage $V_{CS}$ ($=V_O - V_{EE}$) from the bias circuit 106 depends on a temperature dependencies of the base-emitter voltages $V_2$, $V_4$ and $V_5$ of the transistors $T_2$, $T_4$ and $T_5$.

The temperature dependencies of the base-emitter voltages $V_2$, $V_4$ and $V_5$ of the transistors $T_2$, $T_4$ and $T_5$ can be set almost equal. Considering now the sequential course from the second power supply line $V_{EE}$ to the transistors $T_4$, $T_6$, the resistor $R_{2b}$, the transistors $T_2$, $T_{10}$, the resistor $R_{10}$ and again to the second power supply line $V_{EE}$, the base-emitter voltages $V_4$ and $V_6$ and the base-emitter voltages $V_2$ and $V_{10}$ are disposed in an opposite relation. Hence, the temperature dependencies can be substantially offset.

In short, in combination of the bias circuit 106 and the ECL circuit $Q_9$, the temperature dependency of the current from the current source $Q_{10}$ is reduced.

Furthermore, the first to fifth preferred embodiments, as compared with the sixth preferred embodiment, have an advantage of obtaining an increased clamp voltage by the base-emitter voltage of one transistor. Since the output voltage does not exceed the clamp voltage, an increase in the clamp voltage causes larger output voltage to be outputted.

While the invention has been shown and described in detail, the foregoing description is in all aspects illustrative and not restrictive. It is therefore understood that numerous modifications and variations can be devised without departing the scope of the invention.

We claim:

1. A constant voltage generating circuit comprising:

(a) a first potential point and a second potential point for providing a first potential and a second potential which are different from each other;

(b) an output circuit having (b-1) an output terminal;

(b-2) an output resistor including a first end connected to said output terminal and a second end connected to said second potential point;

(b-3) an output transistor including a first current electrode connected to said first potential point, and a second current electrode connected to said output terminal and a control electrode;

(c) a clamping circuit having (c-1) a clamp output terminal for applying a clamp voltage which is approximately constant with variation of predetermined range to said second potential to output a clamp potential;

(c-2) a variation output terminal for transferring said variation of said clamp voltage;

(d) a feedback circuit having (d-1) a first feedback input terminal connected to said output terminal;

(d-2) a second feedback input terminal connected to said clamp output terminal;

(d-3) a third feedback input terminal;

(d-4) a feedback output terminal for providing said control electrode of said output transistor with a potential which is negatively fed back in response to potential variations of said first to third feedback input terminals;

(d-5) a first resistor connected between said first potential point and said second feedback input terminal;

(d-6) a second resistor connected between said second feedback input terminal and said feedback output terminal;

(d-7) a feedback transistor including a first current electrode connected to said feedback output terminal and said third feedback input terminal, and a control electrode connected to said first feedback input terminal and a second current electrode; and (d-8) a third resistor connected between said second current electrode of said feedback transistor and said second potential point; and (e) a current generating circuit having (e-1) a variation input terminal connected to said variation output terminal, said current generating circuit supplying said third feedback input terminal with a feedback current which increases or decreases in response to a potential difference between a potential of said variation input terminal and said second potential.

2. The constant voltage generating circuit of claim 1, wherein said feedback output terminal and said third feedback input terminal are connected directly to each other in said feedback circuit.

3. The constant voltage generating circuit of claim 1, wherein said third feedback input terminal and said first current electrode of said feedback transistor are connected directly to each other in said feedback circuit.

4. The constant voltage generating circuit of claim 3, wherein said feedback circuit further has (d-9) a fourth resistor for connecting said feedback output terminal to said third feedback input terminal.

5. The constant voltage generating circuit of claim 1, wherein said clamping circuit further has (c-3) a clamp potential generating transistor including a first current electrode connected to said first potential point, a control electrode connected to said clamp output terminal and a second current electrode; and (c-4) a clamp potential variation detecting transistor including a first current electrode connected to said second current electrode of said clamp potential generating transistor, a second current electrode connected to said second potential point and a control electrode connected to said variation output terminal.

6. The constant voltage generating circuit of claim 5, wherein said control electrode and said first current electrode are connected directly to each other in said clamp potential variation detecting transistor.

7. The constant voltage generating circuit of claim 6, wherein said clamping circuit further has (c-5) a diode disposed in series between said second current electrode of said clamp potential generating transistor and said first current electrode of said clamp potential variation detecting transistor.

8. The constant voltage generating circuit of claim 7, wherein said clamping circuit further has (c-6) a resistor disposed in series between said second current electrode of said clamp potential generating transistor and said first current electrode of said clamp potential variation detecting transistor.

9. The constant voltage generating circuit of claim 1, wherein said current generating circuit further has (e-2) a current generating transistor including a first current electrode in which said feedback current flows, a control electrode connected to said variation input terminal and a second current electrode connected to said second potential point.

10. The constant voltage generating circuit of claim 9, wherein said current generating circuit further has (e-3) a first resistor disposed in series between said second current electrode of said current generating transistor and said second potential point.

11. The constant voltage generating circuit of claim 10, wherein said current generating circuit further has (e-4) a second resistor which is connected to said first current electrode of said current generating transistor and in which said feedback current flows.

12. A constant voltage generating circuit, comprising:

(a) a first potential point and a second potential point for providing a first potential and a second potential which are different from each other;

(b) an output circuit having (b-1) an output terminal;

(b-2) an output resistor including a first end connected to said output terminal and a second end connected to said second potential point;

(b-3) an output transistor including a first current electrode connected to said first potential point, a second current electrode connected to said output terminal and a control electrode;

(c) a current mirror circuit having (c-1) an input and an output end;

(c-2) a first branch including a first end connected to said input end and a second end connected to said second potential point;

(c-3) a second branch including a first end connected to said output end and a second end connected to said second potential point, said current mirror circuit supplying said second branch with a current in proportion to a current flowing in said first branch;

(d) a clamping circuit connected to said input end of said current mirror circuit, for applying a clamp voltage which is approximately constant with variation of predetermined range to said second potential to output a clamp potential;

(e) a feedback circuit having (e-1) a first feedback input terminal connected to said output terminal;

(e-2) a second feedback input terminal for receiving said clamp potential;

(e-3) a third feedback input terminal connected to said output end of said current mirror circuit; and (e-4) a feedback output terminal for providing said control electrode of said output transistor with a potential which is negatively fed back in response to potential variations of said first to third feedback input terminals.

13. The constant voltage generating circuit of claim 12, wherein said clamping circuit has (d-1) a clamp potential generating transistor including a first current electrode connected to said first potential point, a second current electrode connected to said input end of said current mirror circuit and a control electrode to be provided with said clamp potential.

14. The constant voltage generating circuit of claim 13, wherein said clamping circuit further has (d-2) a diode disposed in series between the second current electrode of the clamp potential generating transistor and the input end of the current mirror circuit.

* * * * *